US005933911A

United States Patent [19]

Windmeisser

[11] Patent Number: 5,933,911

[45] Date of Patent: Aug. 10, 1999

[54] APPARATUS FOR CLEANING A GROUND

[75] Inventor: Dieter Windmeisser, Munchwilen, Switzerland

[73] Assignee: Diversey Lever, Inc., Plymouth, Mich.

[21] Appl. No.: 08/808,769

[22] Filed: Mar. 3, 1997

[30] Foreign Application Priority Data

Mar. 1, 1996 [EP] European Pat. Off. ..... 96200560

[51] Int. Cl.[6] ..... A47L 11/30

[52] U.S. Cl. ..... 15/320; 15/322; 15/401

[58] Field of Search ..... 15/320, 401, 322

[56] References Cited

U.S. PATENT DOCUMENTS

| | | | |
|---|---|---|---|
| 1,975,380 | 10/1934 | Streich et al. . | |
| 2,989,769 | 6/1961 | Houser | 15/401 X |
| 3,107,387 | 10/1963 | Katt | 15/401 X |
| 4,037,289 | 7/1977 | Dojan . | |
| 4,173,056 | 11/1979 | Geyer . | |
| 4,817,233 | 4/1989 | Waldhauser | 15/401 X |
| 4,879,784 | 11/1989 | Shero | 15/322 |
| 5,241,724 | 9/1993 | Lim | 15/322 |
| 5,309,592 | 5/1994 | Hiratsuka . | |
| 5,319,828 | 6/1994 | Waldhauser et al. | 15/322 X |
| 5,377,382 | 1/1995 | Bores et al. . | |
| 5,419,007 | 5/1995 | Hult et al. | 15/401 |
| 5,628,086 | 5/1997 | Knowlton et al. | 15/401 X |

FOREIGN PATENT DOCUMENTS

| | | |
|---|---|---|
| 017 519 | 10/1980 | European Pat. Off. . |
| 338 773 | 10/1989 | European Pat. Off. . |
| 551 709 | 7/1993 | European Pat. Off. . |
| 1 602 828 | 3/1971 | France . |
| 19510340 | 4/1996 | Germany . |
| 486 499 | 6/1938 | United Kingdom . |
| 92/13480 | 8/1992 | WIPO . |

*Primary Examiner*—Chris K. Moore

[57] ABSTRACT

An apparatus for cleaning a surface is described. The apparatus has a frame with wheels, a cleaning liquid source for supplying a cleaning liquid to the ground which is located on the frame and a suction unit for drawing up cleaning liquid from the ground upon which it is supplied, also located on the frame. The suction unit has one or more squeegees and each squeegee has a strip of rubber material provided with apertures which can be pressed in a close fit over pin parts.

5 Claims, 3 Drawing Sheets

APPARATUS FOR CLEANING A GROUND

FIELD OF THE INVENTION

The present invention relates to a floor cleaning machine. In particular, it relates to a machine suitable for wet cleaning, having a suction for drawing up cleaning liquid applied to the floor surface.

BACKGROUND OF THE INVENTION

Known apparatuses for cleaning a ground, wherein the ground is cleaned using a brush and cleaning liquid, usually have a suction device on the rear part thereof, while the brush and the liquid supply is situated on the front part of the apparatus. Such apparatuses are usually bulky and can only be used in one direction. Furthermore, as a consequence of the configuration of such apparatuses it is often cumbersome to exchange wearing components of rubber material. The present invention has for its object to provide a compact cleaning apparatus which can travel in both forward and rearward direction.

SUMMARY OF THE INVENTION

The present invention is an apparatus for cleaning a ground, which has:

a frame provided with wheels supply means arranged on the frame for supplying cleaning liquid to the ground, a suction arranged on the frame for drawing up the cleaning liquid applied to the ground, wherein the suction has one or more squeegees and wherein the squeegees has a strip of rubber material which is provided on the top with apertures which can be pressed in a close fit over pin parts.

The apparatus according to the present invention may a squeegee which includes a wearing component of rubber material, and it is an object of the invention that this squeegee is easily exchangeable in the case of frequent use. The present invention provides a system with which such rubber components are easy to replace.

According to a further aspect, the present invention provides a floor cleaning apparatus wherein the suction has two squeegees which extend both in front of and behind the brush means, wherein also the rubber wearing component is easily replaceable.

Further advantages, features and details of the present invention are elucidated on the basis of the following description of a preferred embodiment thereof with reference to the annexed drawings.

DETAILED DESCRIPTION OF PREFERRED EMBODIMENTS

Figure 1:
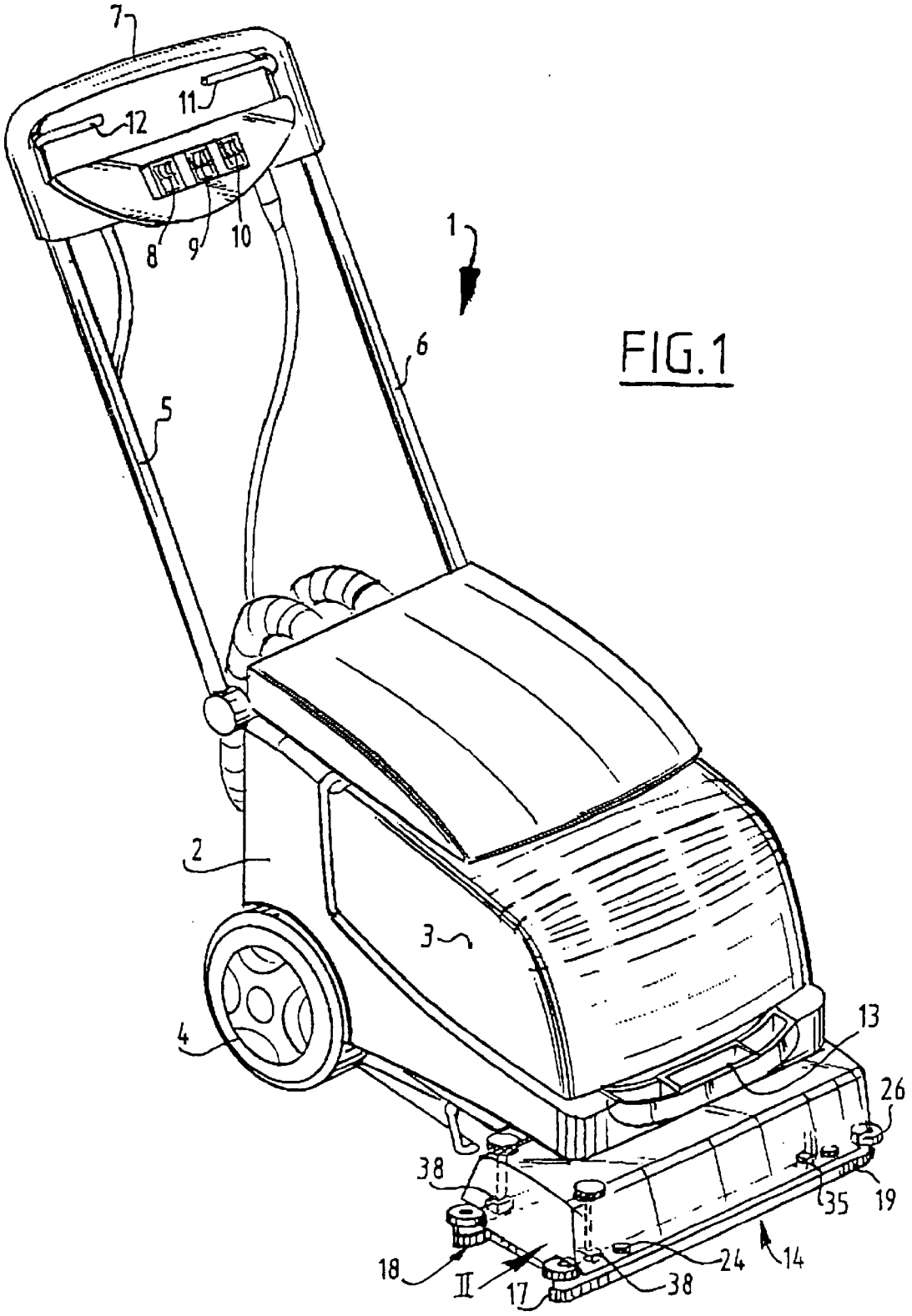
FIG. 1 shows a view in perspective of a preferred embodiment of an apparatus according to the present invention.
Figure 2:
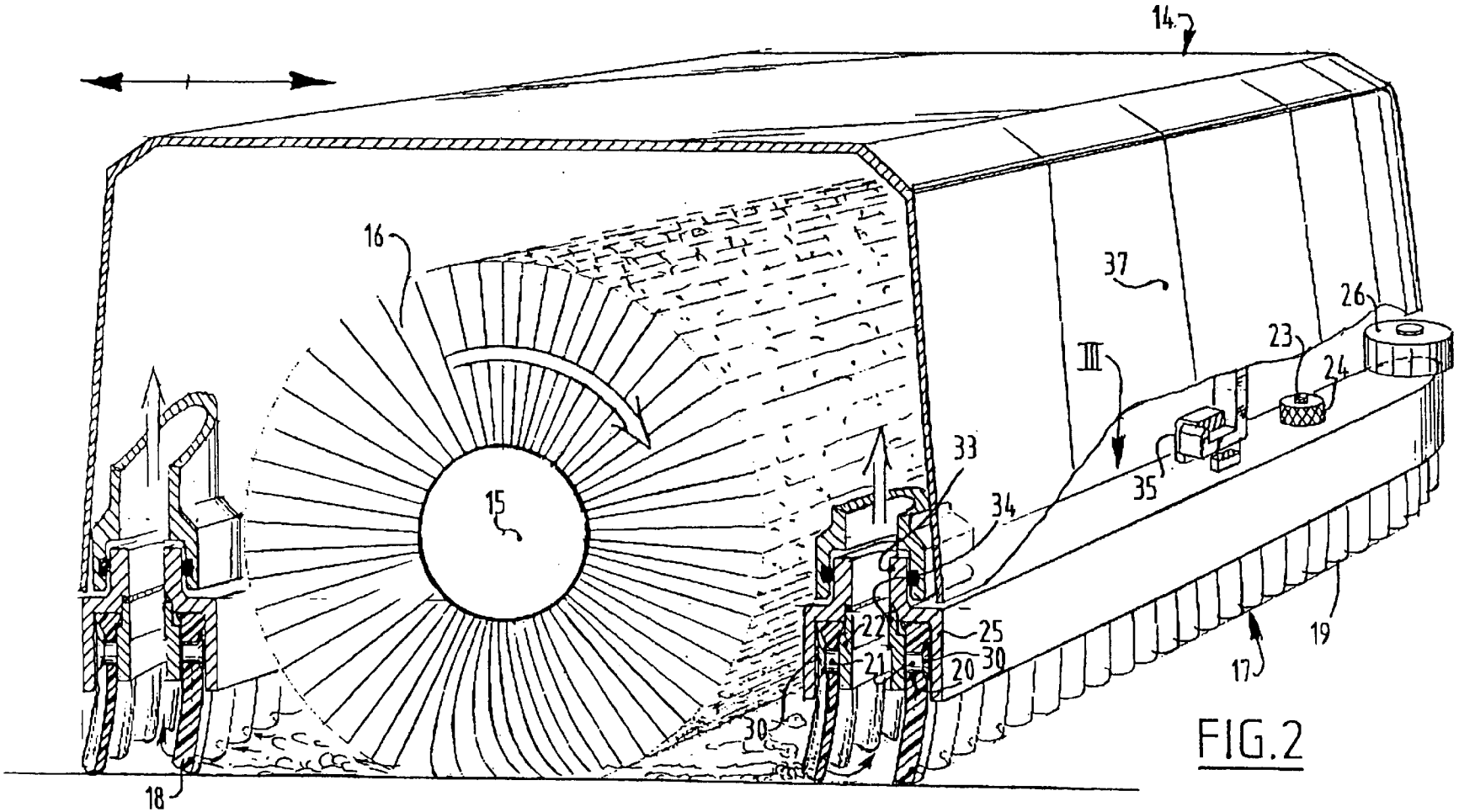
FIG. 2 is a view in perspective of detail III of FIG. 1.

An floor cleaning apparatus (1) according to the present invention comprises a tank (2) for fresh cleaning liquid and a tank (3) for collecting sucked up cleaning liquid, which tanks are arranged in a manner not shown on a frame. On this frame wheels are likewise arranged, of which the right-hand rear wheel (4) is shown in FIG. 1. Extending on the rear part of the apparatus are push bars (5, 6) which are arranged pivotally on a pivot shaft and which extend up to a hand-grip (7) for the user. Close to hand-grip (7) are arranged diverse switches (8, 9, 10, 11 and 12) for actuating the various functions of the apparatus such as ON/OFF, suction etc. A hand-grip (13) is arranged on the front for easy lifting of apparatus (1), while a unit (14) is also situated thereunder which, as also shown in FIG. 2, comprises a brush (16) rotatable on a horizontal shaft (15) in addition to suction units (17, 18) , also referred to as squeegees, which draw up the applied liquid. A squeegee (17) (see also FIG. 3) comprises one or more strips (19) of ribbed rubber material which is provided close to the top side with apertures (20) which can be pressed close-fittingly over pin parts (21) which preferably form part of the inner fixing part (22) of one piece of plastic material. The component (22) is further provided with two threaded ends (23) which, using counter-elements (24) on an outer fixing member (25), can be screwed fixedly thereon. The outer fixing member (25) is provided on the outer side with two free-turning wheels (26), (27) respectively to prevent collisions with a side wall. As also shown clearly in FIG. 2, the pin parts preferably have a slightly broader head (30) than the body (31) thereof. The slightly flexible rubber strips (19) are pressed in a simple operation over the heads (30), whereafter the inner fixing part (22) is screwed fixedly on the outer fixing member (25) using the counter-elements (24) so that the rubber strip (19) is enclosed between the inner and outer element.

Figure 3:
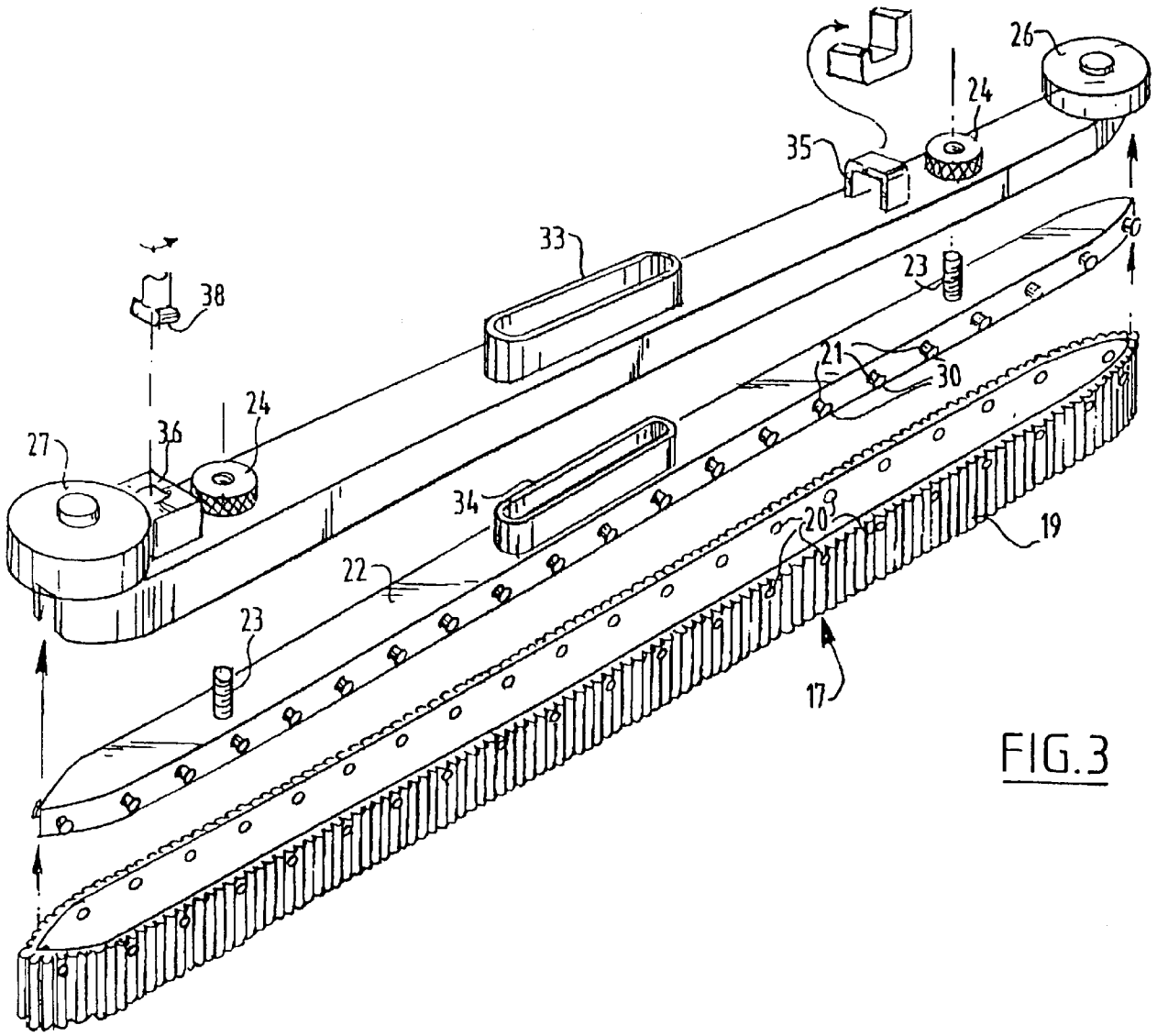
FIG. 3 is an exploded view in perspective of detail III of FIG. 2.

Also shown in FIG. 3 are the suction openings (33) and (34) respectively, the outer and inner fixing element, in addition to further fixing parts (35) and (36) respectively on the outer fixing member (25) for fixing the integral unit of strips of rubber material (19), inner fixing part 22) and outer fixing part (25) to a housing (37) of suction unit (14), preferably with a single screw element (38) (see also FIG. 1).

As shown in FIG. 2, the strips of rubber material are bent slightly due to the underpressure in the squeegees (17)–(18) respectively, and for instance forward movements, so that some air is likewise drawn in between the corrugations in order to enable proper drawing up of the applied cleaning liquid together with this air. The rubber material extends upward beyond the pin parts (30) and, also due to the underpressure, provides a sealing at the top. In addition to easy replaceability of the strips of ribbed rubber material, the present invention also provides a compact cleaning unit which can be used in both forward and rearward direction in a comparatively small space in which it is often also important that this apparatus is easily moved so as to enable the outer periphery of obstacles such as cabinets, tables, chairs etc. to be followed precisely. It has been found that the cleaning liquid has a sufficiently long activity when the squeegees are placed immediately in front of and behind the brush with which the cleaning liquid is brushed onto the ground. With this construction the apparatus according to the present invention becomes much more compact and manouevrable than those of the prior art wherein the squeegee is situated behind the rear wheels.

It is emphasized that the floor cleaning apparatus shown in the figures illustrates only a preferred embodiment of the invention and that various constructional alternatives will be immediately evident to the person skilled in the art, without departing from the scope of the present invention.

I claim:

1. An apparatus for cleaning a surface comprising:

a) a frame provided with wheels;

b) supply means arranged on the frame for supplying cleaning liquid to the surface;

c) suction means arranged on the frame for drawing up the cleaning liquid applied to the surface, said suction means comprising at least one squeegee having a rubber material vertically positioned relative to the frame wherein the rubber material is provided on its top with apertures which are releasably pressed in a close fit over pin parts arranged on an oblong-shaped inner fixing part such that the inner fixing part is surrounded by the rubber material and, wherein the inner fixing part is fixable to an outer fixing part such that the inner fixing part is located within the outer fixing part, whereby the rubber material is connected between the inner and outer fixing parts.

2. The apparatus according to claim 1 wherein the inner fixing part is manufactured from one piece of plastic material.

3. The apparatus according to claim 1 wherein the suction means extend immediately in front of and immediately behind the supply means.

4. The apparatus according to claim 3 wherein the apparatus further comprises brush means for brushing the ground surface using the cleaning liquid.

5. The apparatus according to claim 4 wherein the suction means comprise two squeegees, one squeegee extends in front of and the other squeegee extends behind the brush means, in the direction of operation.

* * * * *